US008393419B1

(12) United States Patent
Burton

(10) Patent No.: US 8,393,419 B1
(45) Date of Patent: Mar. 12, 2013

(54) SUPERABRASIVE ELEMENTS HAVING INDICIA AND RELATED APPARATUS AND METHODS

(75) Inventor: Regan L. Burton, Saratoga Springs, UT (US)

(73) Assignee: US Synthetic Corporation, Orem, UT (US)

( * ) Notice: Subject to any disclaimer, the term of this patent is extended or adjusted under 35 U.S.C. 154(b) by 95 days.

(21) Appl. No.: 12/404,226

(22) Filed: Mar. 13, 2009

Related U.S. Application Data

(60) Provisional application No. 61/036,315, filed on Mar. 13, 2008.

(51) Int. Cl.
*E21B 10/46* (2006.01)

(52) U.S. Cl. ..... 175/426

(58) Field of Classification Search ..... 175/426
See application file for complete search history.

(56) References Cited

U.S. PATENT DOCUMENTS

| | | | | | |
|---|---|---|---|---|---|
| 3,574,911 | A | * | 4/1971 | Penoyar | 407/114 |
| 4,400,117 | A | * | 8/1983 | Smith | 407/49 |
| 4,604,106 | A | | 8/1986 | Hall et al. | |
| 4,629,373 | A | | 12/1986 | Hall | |
| 4,712,473 | A | * | 12/1987 | Amos | 101/4 |
| 4,722,405 | A | * | 2/1988 | Langford, Jr. | 175/374 |
| 4,987,800 | A | | 1/1991 | Gasan et al. | |
| 5,173,091 | A | | 12/1992 | Marek | |
| 5,460,233 | A | * | 10/1995 | Meany et al. | 175/428 |
| 5,511,917 | A | * | 4/1996 | Dickson | 411/439 |
| 5,643,523 | A | * | 7/1997 | Simpson | 264/400 |
| 5,669,271 | A | | 9/1997 | Griffin et al. | |
| D390,854 | S | * | 2/1998 | Satran et al. | D15/139 |
| D396,479 | S | * | 7/1998 | Satran et al. | D15/139 |
| 5,791,832 | A | * | 8/1998 | Yamayose | 407/113 |
| 5,853,268 | A | * | 12/1998 | Simpson | 407/119 |
| 5,972,233 | A | * | 10/1999 | Becker et al. | 216/28 |
| 6,073,552 | A | * | 6/2000 | Cruse et al. | 101/32 |
| 6,123,488 | A | * | 9/2000 | Kasperik et al. | 407/113 |
| 6,149,355 | A | * | 11/2000 | Fouquer et al. | 407/113 |
| 6,170,583 | B1 | * | 1/2001 | Boyce | 175/426 |
| 6,190,096 | B1 | * | 2/2001 | Arthur | 407/113 |
| 6,209,185 | B1 | * | 4/2001 | Scott | 29/458 |
| 6,322,296 | B1 | * | 11/2001 | Wetli et al. | 407/42 |
| 6,573,523 | B1 | * | 6/2003 | Long | 250/559.4 |
| 6,695,558 | B2 | * | 2/2004 | Shibata | 411/439 |
| 6,793,681 | B1 | | 9/2004 | Pope et al. | |
| 6,843,628 | B1 | * | 1/2005 | Hoffmeister et al. | 411/14 |
| 6,990,866 | B2 | * | 1/2006 | Kibblewhite | 73/761 |
| 7,021,878 | B1 | * | 4/2006 | Albertson et al. | 411/439 |
| 7,159,654 | B2 | * | 1/2007 | Ellison et al. | 166/250.01 |

(Continued)

FOREIGN PATENT DOCUMENTS

WO WO 2009/061766 A2 5/2009

*Primary Examiner* — Jennifer H Gay
(74) *Attorney, Agent, or Firm* — Holland & Hart LLP

(57) ABSTRACT

A cutting element for use on a rotary drill bit for forming a borehole in a subterranean formation may comprise a body and laser-generated indicia on at least a portion of the body of the cutting element. The laser-generated indicia may be provided on at least a portion of a substrate of the cutting element and/or at least a portion of a layer of superabrasive material of the cutting element. The laser-generated indicia may be used to indicate a product name of the cutting element, the name of a manufacturer of the cutting element, a preferred alignment for the cutting element relative to a drill bit, or any other useful information. Cutting elements and superabrasive inserts having laser-generated indicia may be employed in rotary drill bits. In addition, laser-generated indicia may be used in a method to distinguish between cutting elements having substantially identical external geometric features.

14 Claims, 5 Drawing Sheets

U.S. PATENT DOCUMENTS

| | | | | |
|---|---|---|---|---|
| 7,441,462 | B2 * | 10/2008 | Kibblewhite | 73/761 |
| 7,520,800 | B2 * | 4/2009 | Duescher | 451/527 |
| 7,585,342 | B2 * | 9/2009 | Cho | 51/309 |
| 7,650,792 | B2 * | 1/2010 | Kibblewhite | 73/761 |
| 8,079,786 | B2 * | 12/2011 | Corbin | 407/113 |
| 2004/0065154 | A1 * | 4/2004 | Kibblewhite | 73/761 |
| 2005/0032469 | A1 * | 2/2005 | Duescher | 451/548 |
| 2006/0076849 | A1 * | 4/2006 | Sedgwick et al. | 310/261 |
| 2006/0123917 | A1 * | 6/2006 | Kibblewhite | 73/761 |
| 2008/0240880 | A1 * | 10/2008 | Durand | 409/131 |
| 2008/0312006 | A1 * | 12/2008 | Zielke et al. | 473/324 |
| 2009/0260877 | A1 * | 10/2009 | Wirth | 175/40 |
| 2010/0239386 | A1 * | 9/2010 | Sedgwick et al. | 411/402 |
| 2010/0248595 | A1 * | 9/2010 | Dinh-Ngoc et al. | 451/56 |
| 2010/0330886 | A1 * | 12/2010 | Wu et al. | 451/56 |
| 2011/0076925 | A1 * | 3/2011 | Sung | 451/8 |
| 2012/0048626 | A1 * | 3/2012 | Bellin | 175/430 |

* cited by examiner

SUPERABRASIVE ELEMENTS HAVING INDICIA AND RELATED APPARATUS AND METHODS

CROSS-REFERENCE TO RELATED APPLICATIONS

This Application claims the benefit of U.S. Provisional Application No. 61/036,315, entitled CUTTING ELEMENTS HAVING LASER-GENERATED INDICIA AND DRILL BITS SO EQUIPPED, filed on Mar. 13, 2008, the disclosure of which is incorporated by reference herein in its entirety.

BACKGROUND

Drilling or boring tools employing cutting elements or inserts, such as polycrystalline diamond cutting elements and inserts, have been used for drilling subterranean formations for a number of years. Examples of subterranean drilling or boring tools include drill bits (e.g., fixed-cutter drill bits and roller-cone drill bits), reamers, stabilizers, and percussion boring and drilling tools.

Conventional polycrystalline diamond cutting elements or inserts typically comprise a diamond layer or table formed under ultra-high temperature, ultra-high pressure (HPHT) conditions onto a substrate, typically of cemented tungsten carbide (WC). A catalyst may also be used to facilitate formation of polycrystalline diamond. The substrate may be brazed or otherwise joined to an attachment member, such as a stud, or a cylindrical backing.

Although the composition of cutting elements may vary, the external geometric features of differing cutting elements are often substantially identical. Unfortunately, because of this, it may be difficult to distinguish between differing cutting elements based solely on a visual inspection of the cutting elements. Similarly, other superabrasive elements may be difficult to distinguish from one another based on their geometric features, even though the composition of such elements may vary.

SUMMARY

The present invention includes embodiments of superabrasive elements having a body and laser-generated indicia on at least a portion of the body. In one embodiment, the body of a superabrasive element may include a substrate and a layer of superabrasive material disposed on an end surface of the substrate. The laser-generated indicia may be disposed on at least a portion of the substrate and/or at least a portion of the layer of superabrasive material. The laser-generated indicia may comprise indicia that indicates a product name of the cutting element, indicia that indicates a product type of the superabrasive element, indicia that indicates a preferred alignment of the superabrasive element relative to some other component, indicia that indicates the name of a manufacturer of the superabrasive element, and/or any additional information.

In another embodiment, a cutting element for use on a rotary drill bit for forming a borehole in a subterranean formation may comprise a body and laser-generated indicia on at least a portion of the body of the cutting element. In certain embodiments, the body of the cutting element may comprise a substrate and a layer of superabrasive material disposed on an end surface of the substrate. The laser-generated indicia may be disposed on at least a portion of the substrate and/or at least a portion of the layer of superabrasive material.

The laser-generated indicia may comprise indicia that indicates a product name of the cutting element, indicia that indicates a cutter type of the cutting element, indicia that indicates a preferred alignment of the cutting element relative to a drill bit, indicia that indicates the name of a manufacturer of the cutting element, and/or any additional information.

As will be described in greater detail below, cutting elements having laser-generated indicia may also be used in connection with rotary drill bits. For example, a rotary drill bit for drilling a subterranean formation may comprise a bit body and a cutting element coupled to at least a portion of the bit body. The cutting element may comprise a body and laser-generated indicia on at least a portion of the body of the cutting element.

Methods for using laser-generated indicia to distinguish between cutting elements having substantially identical external geometric features are also disclosed. In one embodiment, such a method may comprise identifying a first cutting element comprising a body and laser-generated indicia on at least a portion of the body, identifying a second cutting element comprising a body, and distinguishing the first cutting element from the second cutting element based on the laser-generated indicia of the first cutting element.

In an additional embodiment, the second cutting element may also comprise laser-generated indicia on at least a portion of the body of the second cutting element. In this example, the first cutting element may be distinguished from the second cutting element by comparing the laser-generated indicia on the first cutting element with the laser-generated indicia on the second cutting element. In certain embodiments, the second cutting element may have external geometric features that are substantially identical to external geometric features of the first cutting element.

Additionally, methods of providing indicia for such distinguishing processes are provided herein.

In yet another embodiment, a superabrasive element includes a body having a superabrasive material and a chemically modified region of the body selectively configured as indicia. The indicia may be configured and utilized as described with other embodiments set forth herein.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
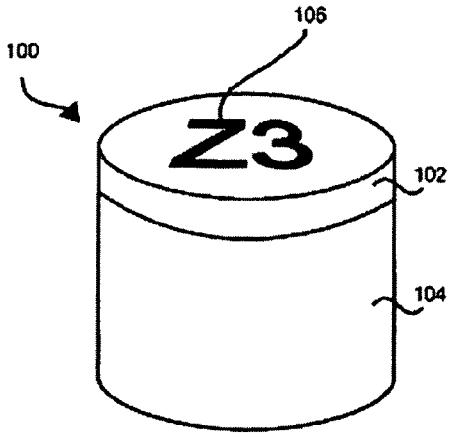
FIG. 1 is a perspective view of an exemplary cutting element according to at least one embodiment.
Figure 2:
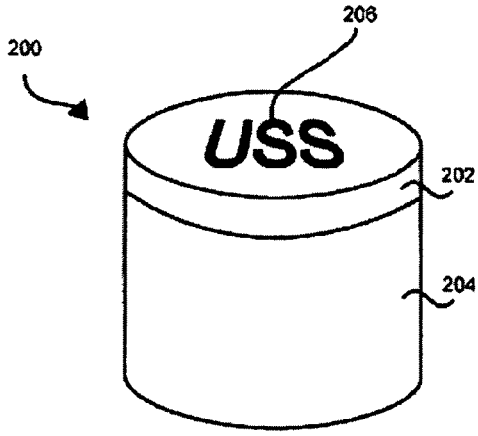
FIG. 2 is a perspective view of an exemplary cutting element according to an additional embodiment.
Figure 3:
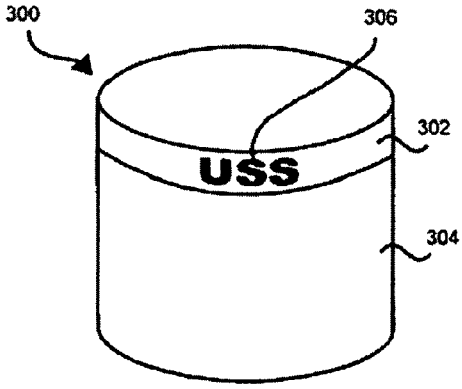
FIG. 3 is a perspective view of an exemplary cutting element according to an additional embodiment.
Figure 4:
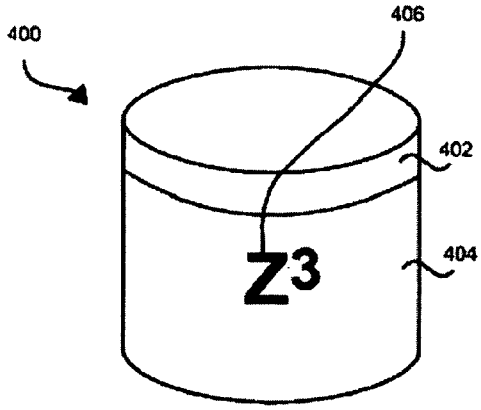
FIG. 4 is a perspective view of an exemplary cutting element according to an additional embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

Various elements, such as superabrasive elements (also referred to as superabrasive inserts), polycrystalline diamond elements and cutting elements, having laser-generated indicia are disclosed herein. In certain embodiments, laser-generated indicia may be used to distinguish between such elements having substantially identical external geometric features. In additional embodiments, laser-generated indicia may also be used, for example, to indicate a product name of the element, to indicate a product type of the element, to indicate a preferred alignment of the element relative to some other component in which the element is to be disposed (e.g., a cutting elements orientation on a drill bit), or to indicate the name of a manufacturer of the element.

The following will provide, with reference to FIGS. 1-8, detailed descriptions of cutting elements having laser-generated indicia. It is noted, however, that the discussion of cutting elements that follows is also applicable to other superabrasive or PCD elements not configured as cutting elements. A detailed description of subterranean drill bits equipped with cutting elements and inserts having laser-generated indicia is also be provided in connection with FIGS. 9-10. A description of a method for using laser-generated indicia to, for example, distinguish between cutting elements or inserts having substantially identical external geometric features is additionally provided in connection with FIG. 11.

FIG. 1 is a perspective view of an exemplary cutting element 100 according to at least one embodiment. Cutting element 100 may represent any cutting element capable of cutting a subterranean formation. Examples of cutting element 100 include, without limitation, a polycrystalline diamond cutter (PDC), an insert, or any other superabrasive cutter. Cutting element 100 may be formed in any configuration and of any material or combination of materials. For example, as illustrated in FIG. 1, cutting element 100 (or 200, 300, 400, 500, 600, 700 or 800 shown in FIGS. 2 through 8, respectively,) may comprise a superabrasive table or layer 102 (or 202, 302, 402, 502, 602, 702 or 802 shown in FIGS. 2 through 8, respectively,) formed upon a substrate 104 (or 204, 304, 404, 504, 604, 704 or 804 shown in FIGS. 2 through 8, respectively). Optionally, cutting element 100 may comprise a unitary or integrally formed structure comprising, for example, diamond, silicon carbide, boron nitride, or any combination of the foregoing.

Superabrasive layer 102 may represent any material or combination of materials suitable for use in cutting applications, including, for example, a superhard or superabrasive material such as polycrystalline diamond, cubic boron nitride, silicon carbide, tungsten carbide, combinations of the foregoing, or any material or combination of materials exhibiting a hardness at least equal to a hardness of tungsten carbide. Superabrasive layer 102 may also be formed in any shape or size. For example, superabrasive layer 102 may comprise an arcuate major exterior surface or a substantially planar major exterior surface.

In at least one embodiment, superabrasive layer 102 may be formed by sintering a layer of diamond or cubic boron nitride crystal powder under HPHT conditions. These HPHT conditions may cause the diamond crystals or grains to bond to one another to form a skeleton or matrix of diamond through diamond-to-diamond bonding between adjacent diamond particles or other crystalline particles. Additionally, relatively small pore spaces or interstitial spaces may be formed within the diamond structure due to HPHT sintering of superabrasive layer 102.

In certain embodiments, a catalyst may be used to facilitate formation of superabrasive layer 102. In at least one embodiment, a so-called solvent catalyst may be used to facilitate the formation of superabrasive layer 102. Examples of solvent catalysts useful for forming superabrasive layer 102 include, without limitation, cobalt, nickel, and iron. In an additional embodiment, during sintering, a solvent catalyst contained in substrate 104 (e.g., cobalt from a cobalt-cemented tungsten carbide substrate) may become liquid, and the liquid solvent catalyst may sweep from the region adjacent to the diamond powder into the diamond grains. In certain embodiments, prior to sintering, a solvent catalyst may be mixed with a diamond powder used in forming a polycrystalline diamond table.

Additionally, a solvent catalyst may dissolve carbon. Such carbon may be dissolved from diamond grains or portions of diamond grains that graphitize due to the high temperatures of sintering. When the solvent catalyst is cooled, carbon held in solution in the solvent catalyst may precipitate or otherwise be expelled from the solvent catalyst and may facilitate formation of diamond bonds between abutting or adjacent diamond grains. Thus, diamond grains may become mutually bonded to form superabrasive layer 102 upon substrate 104.

In certain embodiments, a solvent catalyst may remain in superabrasive layer 102 within interstitial pores existing between diamond grains. In at least one embodiment, subsequent to sintering and after formation of superabrasive layer 102, a solvent catalyst material (e.g., cobalt, nickel, etc.) may be at least partially removed (e.g., by acid-leaching) from superabrasive layer 102. Optionally, another material may replace the solvent catalyst material that has been at least partially removed from superabrasive layer 102. In an additional embodiment, various boundary surfaces may be formed between a first region of superabrasive layer 102, which region may include a catalyst, and a second region of superabrasive layer 102, from which region at least a portion of a catalyst may be removed.

Substrate 104 may represent any material or combination of materials suitable for supporting a superabrasive material during drilling of a subterranean formation, including, for example, cemented tungsten carbide, cobalt, carbides, or various refractory materials. Substrate 104 may also be formed in any shape or size, including, for example, a cylindrical or a disc shape. In an additional embodiment, substrate 104 may comprise at least one additional material, such as a metal material, which may include, for example, a refractory metal.

In at least one embodiment, cutting element 100 in FIG. 1 may also comprise one or more laser-generated indicia 106. As used herein, the phrase "laser-generated indicia" may generally refer to any marking (graphical, textual, or otherwise) generated by a laser. Examples of laser-generated indicia 106 include, without limitation, laser-generated text (such as a manufacturer name, a product name, a cutter type, or any other suitable text), laser-generated graphics (such as company logos, product logos, and other graphics), and any other form of laser-generated markings, including shapes (such as lines, dots, dashes, or the like). The laser-generated indicia 106 includes a chemically modified region due to exposure to a laser. For example, it is believed that exposure to the laser results in oxidation of the material (in the case of indicia 106, oxidation of the superabrasive layer 102) to provide the desired indicia 106.

In the example illustrated in FIG. 1, the product name "Z3" (element 106) may be inscribed or marked by a laser on a top surface of superabrasive layer 102 to indicate the product name for cutting element 100 (in this case, Z3). Similarly, in the example illustrated in FIG. 2, the text "USS" (element 206) may be inscribed or marked by a laser on a top surface of superabrasive layer 202 to indicate the name of a manufacturer of cutting element 200 (in this case, US Synthetic Corporation).

As detailed above, one or more laser-generated indicia may be disposed on one or more portions of a cutting element. For example, laser-generated indicia may be provided on at least a portion of a superabrasive table of a cutting element and/or at least a portion of a substrate of a cutting element. Such laser-generated indicia may be provided on at least a portion of an end surface of the substrate or superabrasive layer, on at least a portion of a side surface of the substrate or superabrasive layer, or any combination thereof. In the example illustrated in FIG. 3, the text "USS" (element 306) may be inscribed or marked on a side surface of superabrasive layer 302 in order to indicate the name of the manufacturer of cutting element 300 (in this case, US Synthetic Corporation). In contrast, the text "Z3" (element 406) may be inscribed or marked on a side surface of substrate 404 of cutting element 400 in FIG. 4 to indicate a product name for cutting element 400 (in this case, Z3).

Figure 5:
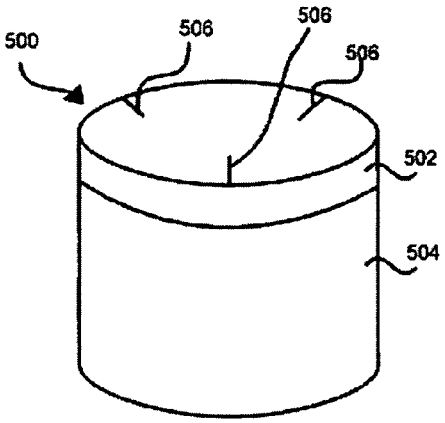
FIG. 5 is a perspective view of an exemplary cutting element according to an additional embodiment.

In certain embodiments, laser-generated indicia may be used to indicate a preferred alignment of a cutting element relative to a drill bit. As will be described in greater detail below, cutting elements may be affixed to (e.g., by press fitting, braising, or otherwise affixing) a drill bit, such as drill bits 900 and/or 1000 in FIGS. 9 and 10, for use in drilling a subterranean formation. In such an embodiment, laser-generated indicia may be used as a witness mark to indicate a preferred alignment of the cutting element relative to the drill bit. For example, as illustrated in FIG. 5, one or more laser-generated indicia 506, such as lines or other markings, may be marked or inscribed on a top surface of superabrasive layer 502 of cutting element 500 by a laser to indicate how cutting element 500 should preferably be aligned when affixed to a drill bit.

Figure 6:
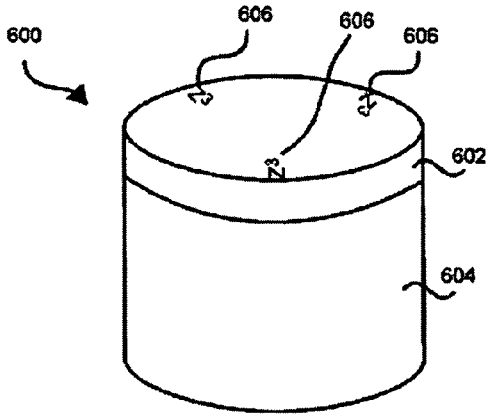
FIG. 6 is a perspective view of an exemplary cutting element according to an additional embodiment.
Figure 7:
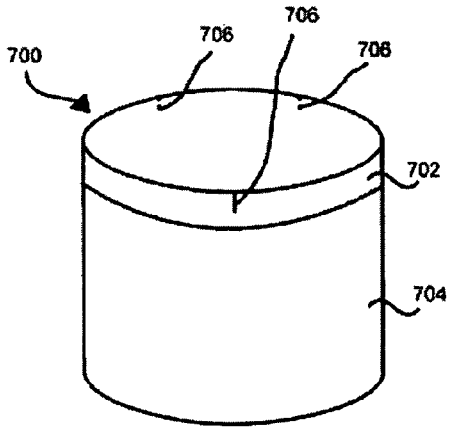
FIG. 7 is a perspective view of an exemplary cutting element according to an additional embodiment.

The laser-generated indicia used to indicate a preferred alignment of a cutting element relative to a drill bit may, as with other laser-generated indicia described herein, represent graphics (such as logos, shapes, lines, or any other graphical marking), text (such as product names, manufacturer names, cutter types, or any other textual marking), or any other laser-generated marking. For example, as illustrated in FIG. 6, the product name of a cutting element 600 (in this case "Z3", element 606) may be marked or inscribed on various locations of a top surface of a superabrasive layer 602 of cutting element 600 to indicate a preferred alignment of cutting element 600 relative to a drill bit.

Figure 8:
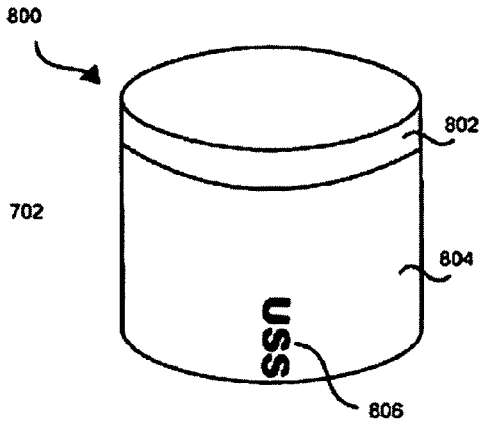
FIG. 8 is a perspective view of an exemplary cutting element according to an additional embodiment.

In an additional embodiment, one or more laser-generated shapes 706 (such as dots, lines, or any other shape or marking) may be marked or inscribed on various locations on a side surface of a superabrasive layer 702 of a cutting element 700 by a laser to indicate a preferred alignment of cutting element 700 relative to a drill bit. Similarly, as illustrated in FIG. 8, a manufacturer's name (in this case "USS", element 806) may be marked or inscribed by a laser on various locations on a side surface of a substrate 804 of a cutting element 800 in order to indicate a preferred alignment of cutting element 800 relative to a drill bit.

Figure 9:
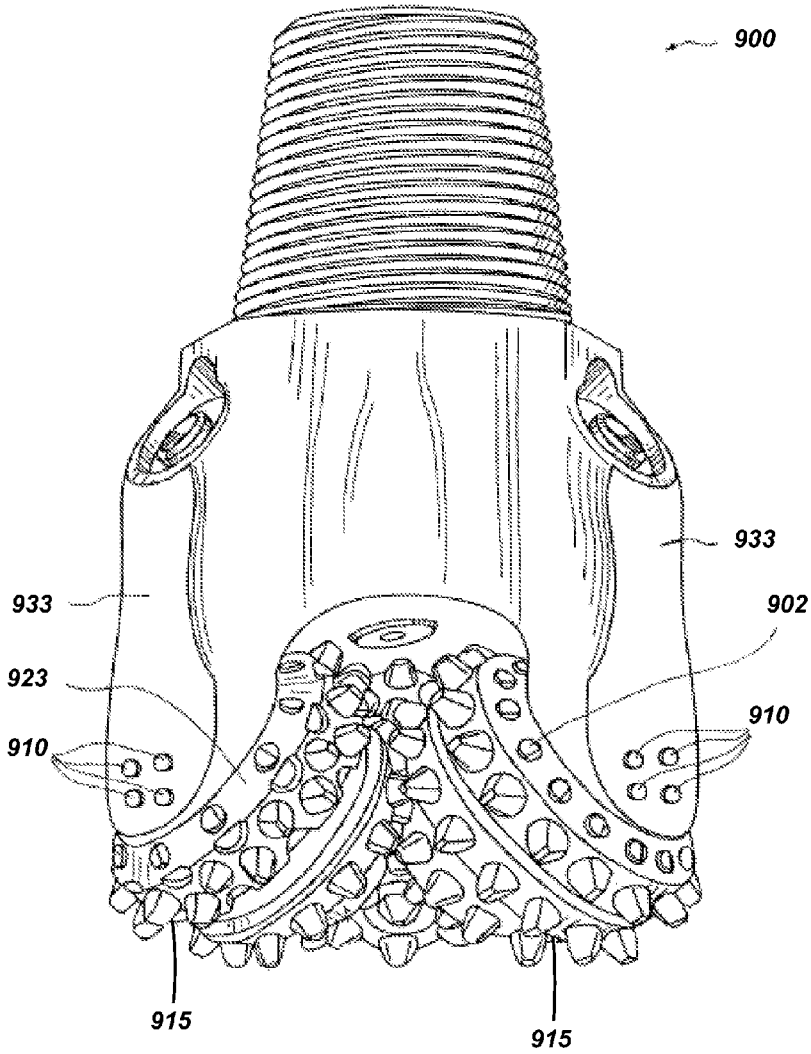
FIG. 9 is a perspective view of a subterranean drill bit comprising at least one cutting element according to at least one embodiment.

As detailed above, one or more of the cutting elements having laser-generated indicia described and/or illustrated herein may be adapted for use in connection with any number of applications. For example, as illustrated in FIG. 9, at least one superabrasive insert 902 having laser-generated indicia may be affixed to a gage surface 923 of at least one cone 915 of a roller cone drill bit 900 and used for cutting or maintaining a gage of a borehole. In this example, superabrasive inserts 902 may prevent or limit gage surface 923 from contacting a borehole or casing. One or more superabrasive inserts 910 having laser-generated indicia may also be affixed to one or more legs 933 of drill bit 900.

Figure 10:
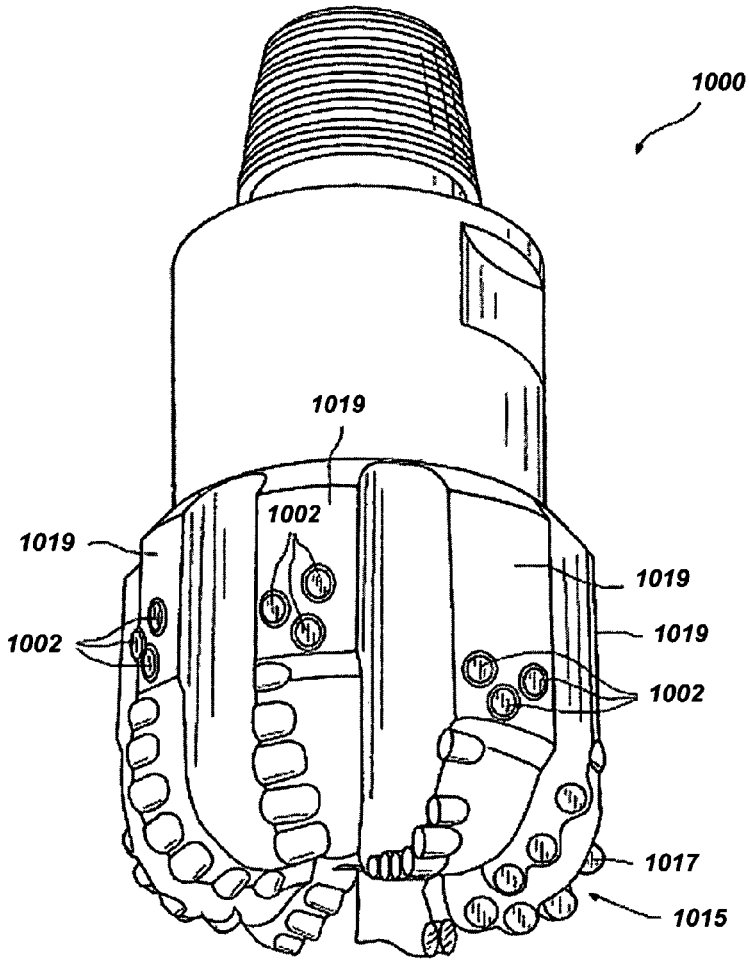
FIG. 10 is a perspective view of a subterranean drill bit comprising at least one cutting element according to an additional embodiment.

In an additional embodiment, at least one cutting element having laser-generated indicia may be affixed to a so-called "fixed cutter" subterranean drill bit, such as fixed-cutter drill bit 1000 in FIG. 10. As illustrated in this figure, one or more cutting elements 1017 having laser-generated indicia may be disposed on a cutting face 1015 of drill bit 1000 in order to effect drilling of a subterranean formation as bit 1000 is rotated in a borehole. One or more superabrasive inserts 1002 having laser-generated indicia may also be affixed to a gage surface 1019 of drill bit 1000 to actively shear formation material at the sidewall of a borehole during subterranean drilling.

In addition, cutting elements or superabrasive inserts having laser-generated indicia may also be used in connection with any number of earth-boring tools or drilling tools, including, for example, core bits, roller-cone bits, fixed-cutter bits, eccentric bits, bicenter bits, roof bolt drill bits, reamers, reamer wings, or any other downhole tool for forming or enlarging a borehole that includes at least one superabrasive insert, without limitation. Moreover, although cutting elements and superabrasive inserts having laser-generated indicia have been discussed in the context of subterranean drilling equipment and applications, such superabrasive inserts and cutting elements are not limited to such use and could be used for varied applications as known in the art, without limitation. For example, superabrasive inserts and cutting elements having laser-generated indicia may be used in the context of any mechanical system including at least one superabrasive insert or cutting element (e.g., bearing apparatuses, wire dies, mining tools, wear pads, gripper pads, heat sinks, scraping tools, etc.). Polycrystalline diamond elements having laser-generated indicia may also be used in various medical-related applications, including, for example, in hip joints and back joints.

Figure 11:
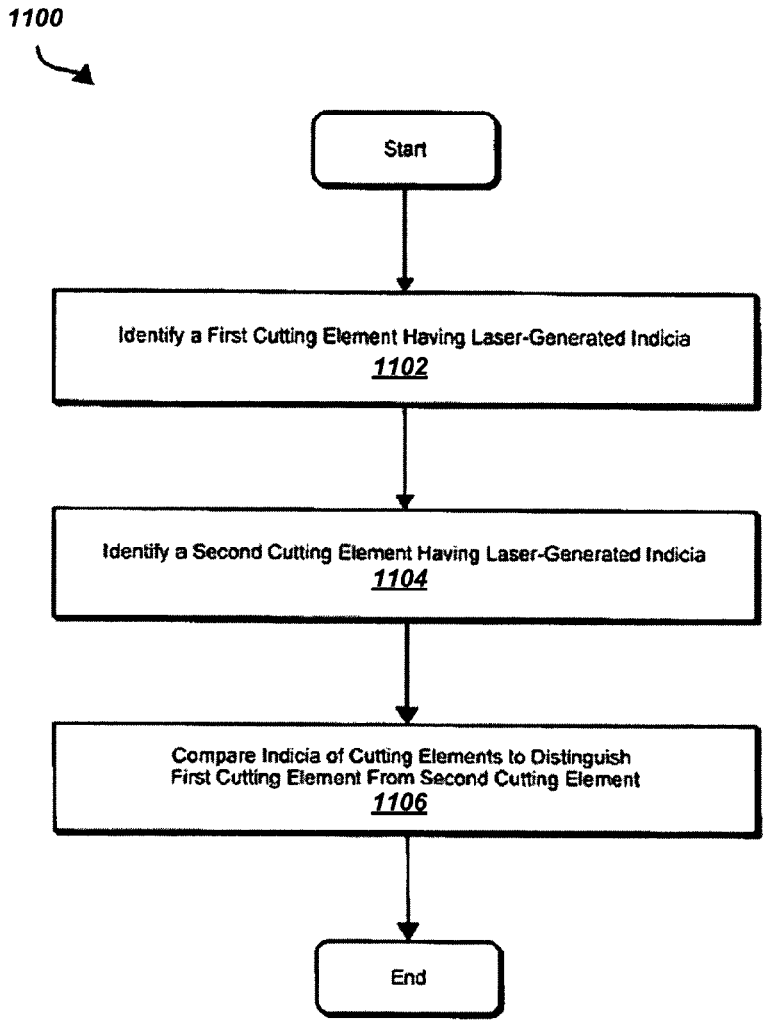
FIG. 11 is a flow diagram of an exemplary method for using laser-generated indicia to distinguish between cutting elements having substantially identical external geometric features according to at least one embodiment.

As detailed above, laser-generated indicia on cutting elements or superabrasive inserts may be used to distinguish between cutting elements or superabrasive inserts having substantially identical external geometric features. FIG. 11 is a flow diagram of an exemplary method 1100 for using such laser-generated indicia to distinguish between cutting elements or superabrasive inserts having substantially identical external geometric features. As illustrated in this figure, and as indicated at 1102, a first cutting element having laser-generated indicia may be identified. As detailed above in connection with FIGS. 1-8, this laser-generated indicia may be disposed on, for example, at least a portion of a substrate of the first cutting element and/or at least a portion of a superabrasive layer of the first cutting element. As explained above, the laser-generated indicia on the first cutting element may indicate a product name of the first cutting element, the name of the manufacturer of the first cutting element, a preferred alignment for the first cutting element relative to a drill bit, or any other useful information.

As indicated at 1104, a second cutting element may be identified. In certain embodiments, this second cutting may be devoid of laser-generated indicia. In additional embodiments, however, laser-generated indicia may be disposed on, for example, at least a portion of a substrate of the second cutting element and/or at least portion of the superabrasive layer of the second cutting element. In this example, as with the laser-generated indicia on the first cutting element, the laser-generated indicia on the second cutting element may indicate a product name of the second cutting element, the name of the manufacturer of the second cutting element, a preferred alignment for the second cutting element relative to a drill bit, or any other useful information.

As indicated at 1106, the laser-generated indicia on the first cutting element may be used to distinguish the first cutting element from the second cutting element. For example, the text "XX-11" may be marked or inscribed on at least a portion of the first cutting element by a laser to indicate that the first cutting element is a XX-11-type cutting element. In this example, the first cutting element may be distinguished from the second cutting element based on the laser-generated indicia ("XX-11") of the first cutting element.

In an additional embodiment, laser-generated indicia on the first cutting element may be compared with laser-generated indicia on the second cutting element to distinguish the first cutting element from the second cutting element. For example, the text "XX-11" may be marked or inscribed on at least a portion of the first cutting element by a laser to indicate that the first cutting element is a XX-11-type cutting element. Similarly, the phrase "XX-22" may be marked or inscribed on at least a portion of the second cutting element by a laser to indicate that the second cutting element is a XX-22-type cutting element. In another embodiment, the second cutting element may simply be devoid of markings as indicated above.

In this example, the indicia on the first cutting element (in this case, "XX-11") may be compared with the indicia on the second cutting element (in this case, "XX-22") to distinguish the first cutting element from the second cutting element, even if the external geometric features of the first cutting element are substantially identical to the external geometric features of the second cutting element. Upon completion of the comparing act indicated by 1106, the exemplary method 1100 shown in FIG. 11 may terminate.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A superabrasive element comprising:

a body including a substrate and a layer of superabrasive material disposed on an end surface of the substrate, the substrate comprising a first material and the layer of superabrasive material comprising a second material different than the first material;

laser-generated indicia on at least a portion of an exposed portion of the substrate of the body, wherein the laser-generated indicia is also formed on the layer of superabrasive material and wherein the laser-generated indicia includes a marking selected from the group consisting of letter, numbers, graphical symbols and combinations thereof.

2. The superabrasive element of claim 1, wherein the substrate comprises at least one of a carbide material, cobalt, and a refractory material.

3. The superabrasive element of claim 1, wherein the superabrasive layer comprises at least one of polycrystalline diamond, cubic boron nitride, silicon carbide, and tungsten carbide.

4. The superabrasive element of claim 1, wherein the laser-generated indicia comprises at least one of:

indicia that indicates at least a product name of the superabrasive element;

indicia that indicates at least a cutter type of the superabrasive element;

or indicia that indicates a manufacturer of the superabrasive element.

5. The superabrasive element of claim 1, wherein the body is configured as a cutting element sized and configured for coupling with a body of a subterranean rotary drill bit.

6. The superabrasive element of claim 1, wherein the laser-generated indicia includes indicia that indicates a preferred alignment of the superabrasive element with another component.

7. A rotary drill bit for drilling a subterranean formation, comprising:

a bit body having a leading face portion configured to engage a subterranean formation and a gage surface;

at least one superabrasive insert coupled to at least one of the leading face portion or the gage surface of the bit body, the superabrasive insert comprising:

a body including a substrate and a layer of superabrasive material disposed on an end surface of the substrate;

laser-generated indicia on at least a portion of an exposed portion of the substrate of the body of the cutting element, wherein the laser-generated indicia is also formed on the layer of superabrasive material and wherein the laser-generated indica includes a marking selected from the group consisting of letters, numbers, graphical symbols and combinations thereof.

8. The rotary drill bit of claim 7, wherein the laser-generated indicia comprises at least one of:

indicia that indicates at least a product name of the superabrasive insert;

indicia that indicates at least a cutter type of the superabrasive insert;

or indicia that indicates a manufacturer of the superabrasive insert.

9. The rotary drill bit of claim 7, wherein the laser-generated indicia includes indicia that indicates a preferred alignment of the superabrasive insert relative to the bit body.

10. A method for using laser-generated indicia to distinguish between superabrasive elements exhibiting the same size and external geometric features, the method comprising:

identifying a first superabrasive element, the first superabrasive element comprising a body having a substrate and a superabrasive material disposed on an end of the substrate, the body also including laser-generated indicia that is on at least a portion of an exposed portion of the substrate of the body and is also formed on the layer of superabrasive material;

identifying a second superabrasive element, the second superabrasive element having the same size and external geometric features as the first superabrasive element;

distinguishing the first superabrasive element from the second superabrasive element based on the laser-generated indicia of the first superabrasive element.

11. The method of claim 10, wherein the second superabrasive element further comprises laser-generated indicia on at least a portion of a body of the second superabrasive element and the first superabrasive element is distinguished from the superabrasive cutting element by comparing the laser-generated indicia on the first superabrasive element with the laser-generated indicia on the second superabrasive element.

12. The method of claim 10, wherein identifying a second superabrasive element includes identifying a second superabrasive element comprising a body having a substrate and a layer of superabrasive material disposed on an end surface of the substrate.

13. The method of claim 10, wherein the laser-generated indicia of the first superabrasive element comprises at least one of:

indicia that indicates at least a product name;

indicia that indicates at least a cutter type;

or indicia that indicates a manufacturer.

14. The method of claim 10, wherein the laser-generated indicia of the first superabrasive element comprises indicia that indicate a preferred alignment relative to a drill bit.

* * * * *